US008544499B2

(12) United States Patent
Rickey

(10) Patent No.: US 8,544,499 B2
(45) Date of Patent: Oct. 1, 2013

(54) VARIABLE ORIFICE FOR PARTICULATE COAL CONDUIT

(76) Inventor: Wark E. Rickey, The Woodlands, TX (US)

( * ) Notice: Subject to any disclaimer, the term of this patent is extended or adjusted under 35 U.S.C. 154(b) by 1471 days.

(21) Appl. No.: 11/704,664

(22) Filed: Feb. 9, 2007

(65) Prior Publication Data

US 2008/0190335 A1 Aug. 14, 2008

(51) Int. Cl.
*F17D 1/20* (2006.01)

(52) U.S. Cl.
USPC ..... 137/601.19; 251/90; 251/208; 251/301; 110/264; 138/46

(58) Field of Classification Search
USPC ..... 251/77, 305, 90, 208, 298, 301, 78; 137/601.19, 601.17, 262, 385, 599.11, 872, 137/561 A; 110/104 R, 327, 264, 118; 138/45, 138/43, 40, 46
See application file for complete search history.

(56) References Cited

U.S. PATENT DOCUMENTS

| | | | | |
|---|---|---|---|---|
| 55,072 | A * | 5/1866 | Doty | 251/75 |
| 1,228,738 | A * | 6/1917 | Barbarou | 251/305 |
| 3,123,098 | A * | 3/1964 | Bishop | 137/601.06 |
| 5,647,389 | A * | 7/1997 | Holloway | 251/90 |
| 5,873,156 | A | 2/1999 | Wark | |
| 6,055,914 | A | 5/2000 | Wark | |
| 6,056,001 | A * | 5/2000 | Boyles et al. | 137/875 |
| 6,186,079 | B1 | 2/2001 | Wark | |
| 6,234,090 | B1 | 5/2001 | Wark et al. | |
| 6,257,415 | B1 | 7/2001 | Wark | |
| 6,799,525 | B2 * | 10/2004 | Manos et al. | 110/106 |
| 8,122,911 | B2 * | 2/2012 | Wark | 138/45 |

* cited by examiner

*Primary Examiner* — John Bastianelli
*Assistant Examiner* — Andrew J Rost
(74) *Attorney, Agent, or Firm* — Young Basile Hanlon & MacFarlane PC

(57) ABSTRACT

A simplified variable orifice for a conduit furnishing a stream of particulate coal to a burner for a turbine in an electrical utility plant. Two plates are installed across the conduit, one of them being fixed and the other being variable in angular position relative to the first. A lockable mechanism is provided externally of the conduit to manually adjust the degree of blocking and to indicate the position of the movable plate.

10 Claims, 5 Drawing Sheets

VARIABLE ORIFICE FOR PARTICULATE COAL CONDUIT

FIELD OF THE INVENTION

This invention relates to a variable orifice for a conduit used to deliver a stream of particulate coal to a burner and more particularly to a variable orifice of simple design and to a method of retrofitting the variable orifice in a conduit which is already in place.

BACKGROUND OF THE INVENTION

It is well known to feed burners, for turbine generator boilers with fuel in the form of airborne particulate coal; structures for carrying out this function are commonly found in electric utility plants throughout the United States and Canada. It is typical in these structures to use a main supply conduit to receive finely pulverized coal from a pulverizer/classifier. It is also typical to divide the main supply conduit into several parallel branches which are connected to individual nozzles or injectors arranged at spaced points around the burner so as to project a stream of particulate coal toward a fireball which is essentially centralized within the burner.

A problem which arises in systems of the type described above is insuring that the branch conduits provide at least approximately equal coal flow rates so that the fireball is stabilized as to size and location and receives essentially equal inputs of fuel from all of the nozzles. The branch conduits are of different lengths and the longer ones present greater resistance to flow. Therefore a variety of devices, hereinafter referred to as "variable orifice" devices, have been created to introduce some additional flow resistance into shorter branches thereby to balance the flows of particulate coal as between parallel branch conduits feeding a single burner. Examples of variable orifices are found in U.S. Pat. Nos. 5,873,156, 6,055,914, 6,186,079, 6,257,415 and 6,234,090.

SUMMARY OF THE INVENTION

According to a first aspect, the present invention provides a variable orifice or valve for varying the effective cross-sectional flow area of a conduit which is used to deliver a stream of particulate coal to a burner. In accordance with the invention, the variable orifice comprises a first plate which is fixably mounted within and extending across the supply conduit such that its plane lies parallel to the direction of flow. In the typical installation, the conduit is essentially round in cross-section and the first plate extends across a diameter of the conduit.

Further in accordance with the invention, a second plate is mounted within and extending across the conduit closely adjacent the first plate but, by means of a mechanical structure such as a rotatable shaft attached to the second plate and to the conduit wall, can be selectively varied in its angular relationship with the first plate. When the second plate is parallel and adjacent the first plate, the effective flow area of the conduit is only minimally reduced. However, when the second plate is rotated toward a position in which it extends at right angles to the flow direction, the effective cross-sectional flow area of the conduit is maximally reduced. In the preferred form, means are provided for selectively fixing the movable plate in any of a number of intermediate positions between the unextended or parallel position and the fully extended, right angle position.

In the preferred form, as hereinafter described, the mechanism further comprises an indicator mechanism such as a lever arm is mounted to the shaft externally of the conduit such that its angular position indicates directly or indirectly the angular position of the second plate in the orifice. As hereinafter described, a locking mechanism is provided in the form of a locking plate with an arcuate arrangement of holes formed in it, the plate being fixed in its position relative to the conduit. The lever arm which rotates with the shaft is provided with a spring-loaded pull-to-release pin which can be fitted into any one of the various holes to lock the variable position plate in the desired angular position.

The typical range of motion for the movable blade is 90 degrees, but additional range of motion of up to about 180 degrees can also be provided.

While the invention is described herein with reference to a manually operable device, it would be apparent to those skilled in the art that the device may also be fixed with a motive power source such as a pneumatic or hydraulic actuator and/or a motor.

DETAILED DESCRIPTION OF THE ILLUSTRATIVE EMBODIMENT

Figure 1:
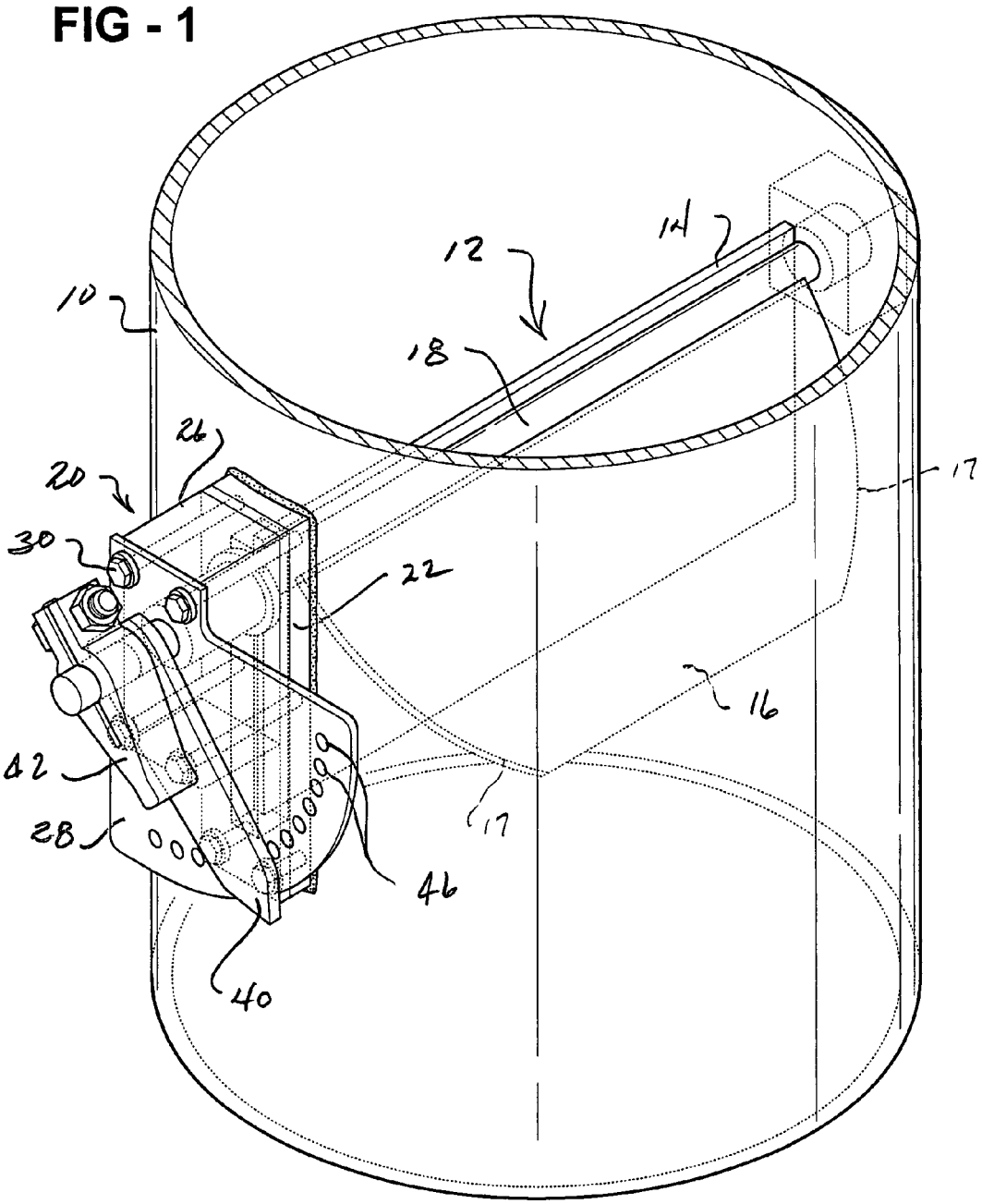
FIG. 1 is a perspective view of a burner supply conduit with an illustrative embodiment of the invention mounted therein.
Figure 2:
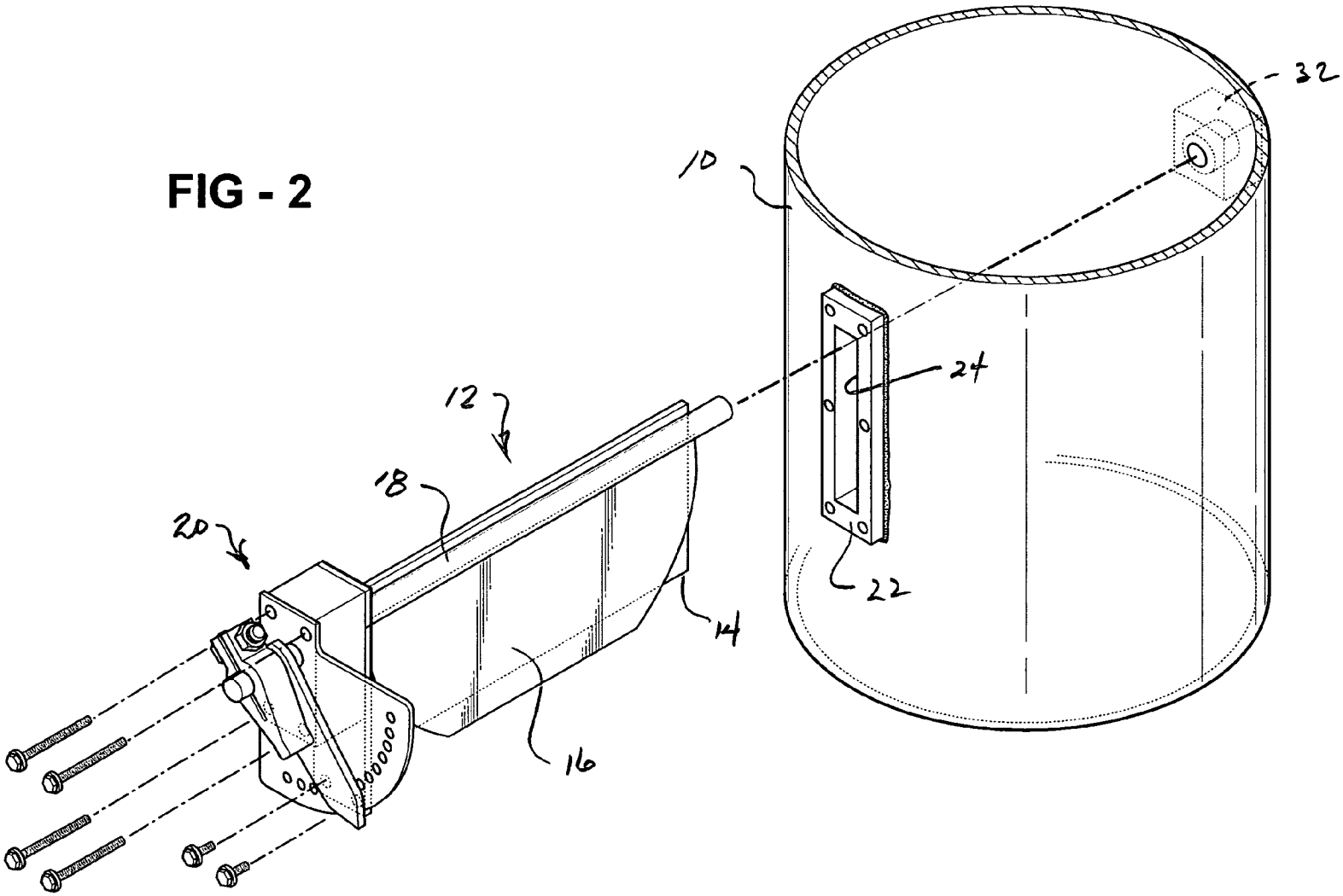
FIG. 2 is an exploded view of the structure of FIG. 1.

Referring to the figures, a round, steel conduit 10 is provided for the purpose of delivering an airborne stream of pulverized, particulate coal to a burner (not shown). In the figures, the conduit ranges in size anywhere from about 14 to 19 inches in diameter and the direction of flow is from bottom to top in each of FIGS. 1, 2, 3 and 5. The manner in which the conduit 10 may fit into an overall system as illustrated in FIG. 1 of Applicant's U.S. Pat. No. 6,899,041 issued May 31, 2005; i.e., it is one of the branch conduits 20, 22, 24 and/or 26 as represented in FIG. 1 of that patent. The disclosure of the aforesaid '041 patent is incorporated herein by reference.

The conduit 10 is provided with a variable orifice 12 for flow rate regulation purposes as generally described above. The variable orifice 12 comprises a first fixed plate 14, a second, angularly movable plate 16, and a mechanical structure including a shaft 18 and an external assembly 20 for varying the angular position of the plate 16 relative to the plates 14. Whether parallel or defining an included angle, the upper or downstream edges of the plates 14 and 16 are always contiguous. The action of the plates 14, 16 is similar to that of a "butterfly" valve wherein only one "wing" moves.

Going now into greater detail, the plate 14 is mounted diametrically across the conduit 10 with its principal plane parallel to the direction of air stream flow in the conduit 10 so as to provide in and of itself a minimal obstruction to flow. The plate 14 has a longitudinal dimension corresponding substantially to the inside diameter of the conduit 10 and an axial dimension of from 6-12 inches. It may be made of high hardness ¼ inch steel alloy plate. The leading edge may be protected with carbide if desired.

Figure 4:
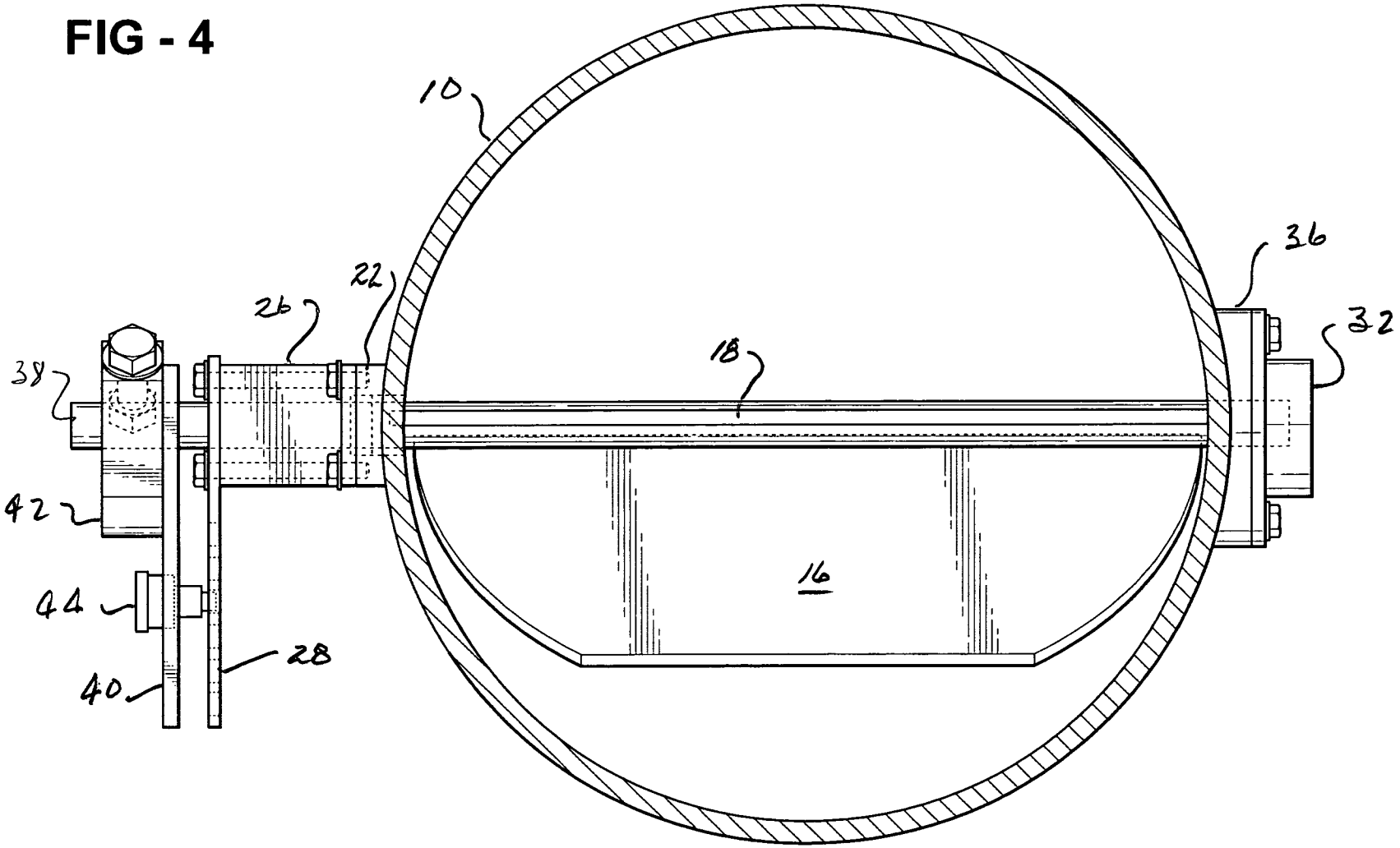
FIG. 4 is a plan view of the structure of FIG. 1.
Figure 5:
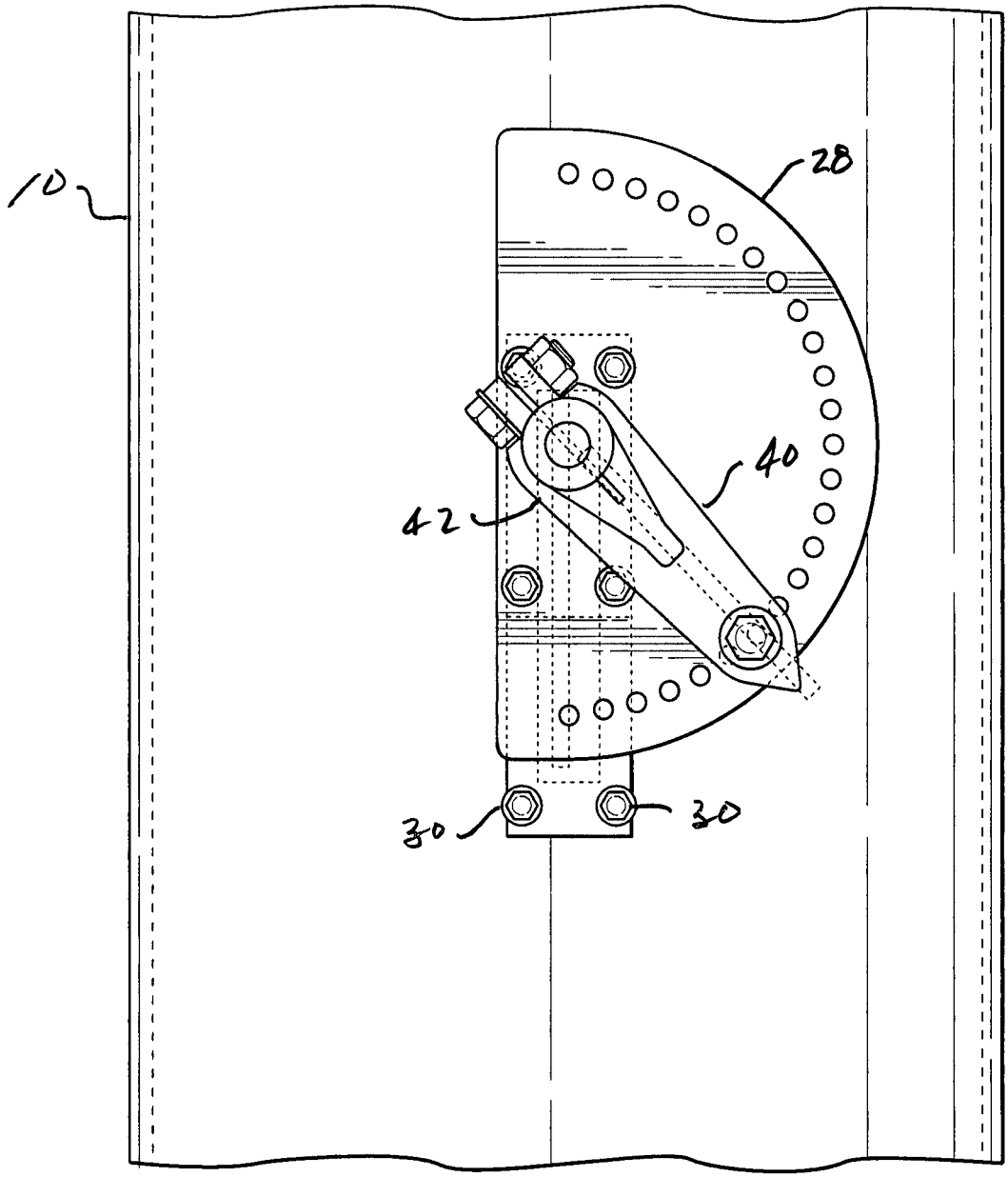
FIG. 5 is a detail of the external indicator and adjustor mechanism in the structure of FIG. 1.

The plate 16 is substantially of the same overall dimensions as the plate 14, but has beveled outside edges 17, to provide clearance with the inside wall of the conduit 10 when its angular position is changed; i.e., when it is rotated up toward a more blocking orientation as shown in the plan view of FIG. 4. The downstream edge of the plate 16 is fixedly attached such as by welding to a shaft 18 which extends diametrically across the conduit 10 to provide for angular rotation of the plate 16. The shaft 18 is immediately adjacent the upper edge of the fixed plate 14.

The external mechanism 20 for adjusting and indicating the angular position of the plate 16 comprises a rectangular steel frame 22 which is welded to the outside wall of the conduit 10 around an elongate slot 24 which is cut into the conduit 10 in the process of installing the variable orifice device 12 as hereinafter described. Attached to the frame 22 is a bearing box 26 which is capped with an arcuate steel locking plate 28 held in place by means of screws 30 which extend through the plate and into tapped holes in the frame 22 as shown. A collar 31 on the shaft 18 is trapped between plates 28 and 33 to provide a thrust bearing.

Optionally a bearing 32 may be mounted by screws or welding to a plate 36 on the diametrically opposite side of the conduit 10 to receive and support as well as to provide for rotation of the distal end of the shaft 18 as it extends through a round hole 34, also cut into the outside wall of the conduit 10.

Figure 3:
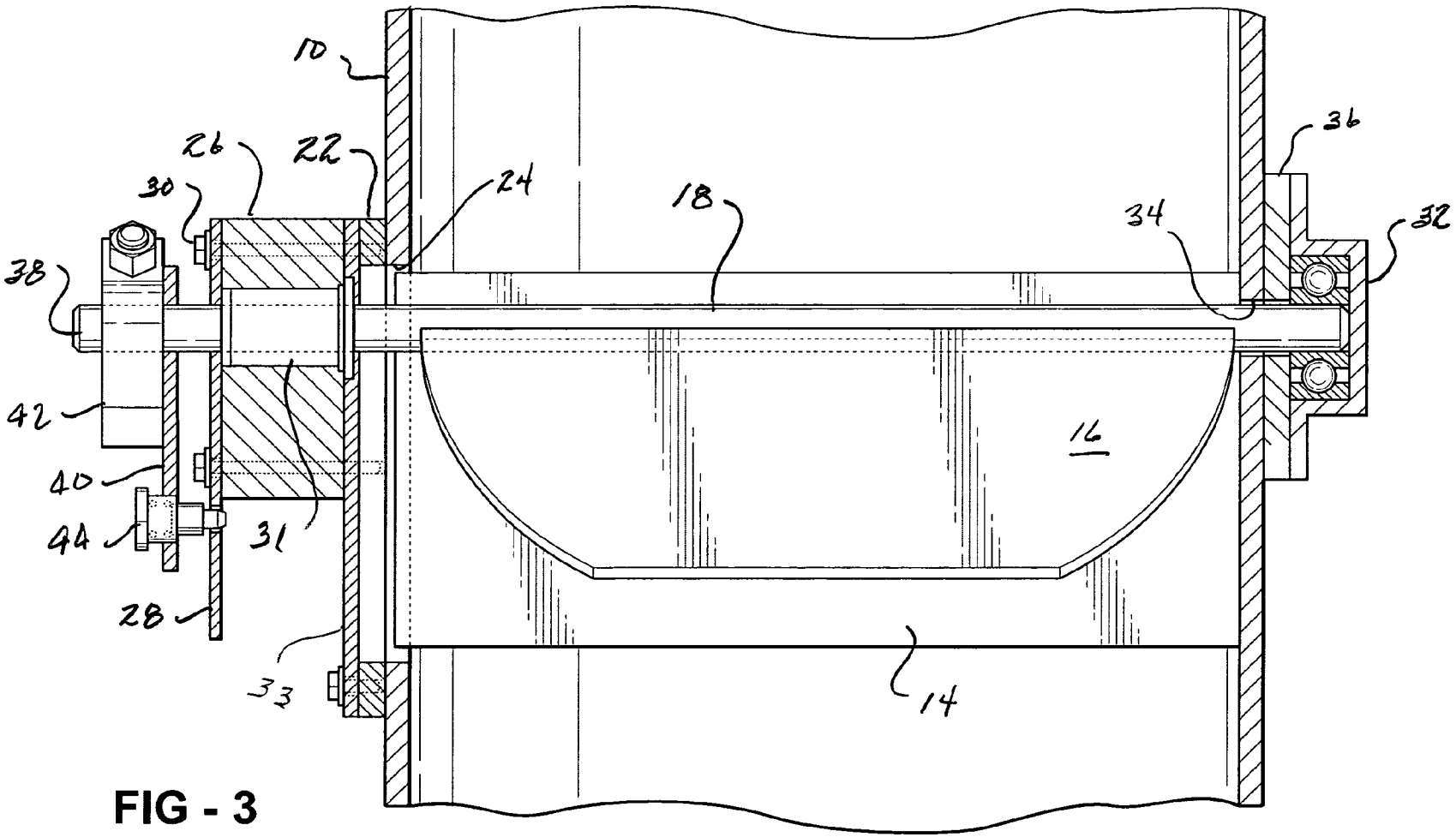
FIG. 3 is a side view partly in section of the structure of FIG. 1.

As best shown in FIGS. 3 and 4, the shaft 18 is of sufficient length such that a portion 38 thereof extends well outside of the conduit 10 through the bearing box 26 to receive a pointer-shaped or lever arm 40 which is attached to a clamp 42 adjustably mounted on the shaft 18. The lever arm 40 carries a spring-loaded, pull-to-release locking element 44 having a pin which interacts with an arcuate arrangement of spaced holes 46 formed in the plate 28 so that the arm 40 and the shaft 18, along with plate 16, can be rotated to the desired angular position and mechanically held in place by means of the lock element 44 and the plate 28.

As shown in the figures, the plate 16 can be rotated between a fully opened or minimally interfering position in which it is directly parallel to the plate 14 and a fully extended or maximally blocking position in which the plate 16 is essentially at right angles to the plate 14 across the diameter plane of the conduit 10. The plate 28, shown in the figures to provide for only 90 degrees of rotation of plate 16, can be extended upwardly to provide for nearly 180 degrees of rotation as desired.

Tests have shown that the variable orifice device 12 provides a flow resistance which varies nearly linearly with angular position of plate 16. While it appears that particulate coal might flow continuously into the crevice between the plates 14 and 16, under actual flow conditions, a pressure bubble builds rapidly within the angularly enclosed area, thereby increasing flow resistance and reducing the rate of flow in proportion to the angular position of plate 16.

Installation of the device 12 is typically carried out by way of the following steps, assuming that the conduit 10 is already in place and that a retrofit installation is necessary.

First, the slot 24 is cut into the conduit wall with the long axis of the slot parallel to the flow direction. The hole 34 is cut as needed directly diametrically across from the upper end of the slot 24 to receive the distal end of the shaft 18 and the bearing block 32.

Next, the frame 22 is welded in place. Note that the slot in the frame overlies the slot formed in the conduit wall and is of sufficient length and width to accommodate passing therethrough the parallel combination of the two plates 14 and 16 and the shaft 18. The combination is pushed through the slot in the frame 22 across the conduit 10 until the opposite or far end of the shaft 18 fits through the hole 34 and into the pre-installed bearing block 32.

The mechanism 20 is now attached to the frame 22, the clamp 42 is adjusted to correspond with the unblocked position of the plate 16 and the device is thereafter fully operable in the manner described above. As previously mentioned, the manual device shown in the drawings may be supplemented with a device having a motive power source such as a fluid cylinder or motor with appropriate remote control.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A variable valve for varying the flow of airborne particulate coal through a single channel flow conduit comprising:

a conduit having a diameter;

a first planar plate having an upstream edge and a downstream edge, said plate being fixedly mounted within and extending across the diameter of said conduit in a plane which is parallel to the flow direction of said stream;

a second planar plate having an upstream edge and a downstream edge and angularly moveably mounted within and extending across said conduit with the downstream edge closely contiguous to the downstream edge of the first plate such that the first and second plates form an acute included angle therebetween wherein the included angle opens toward the flow of particulate coal; and a mechanical structure for selectively varying the angular relationship between the first and second plate such that about half of the cross-sectional area of the conduit remains open irrespective of the position of the second plate.

2. A variable orifice as defined in claim 1 wherein the mechanical structure comprises a shaft extending across the conduit substantially along a diameter thereof and through an outside wall thereof, said shaft being fixedly attached to an edge of the second plate.

3. A variable orifice as defined in claim 2 further including a lever arm attached to the shaft externally of said conduit such that the position of the lever arm indicates the angular position of the shaft and the second plate.

4. A variable orifice as defined in claim 3 further including a lock plate fixably mounted on and external to the conduit, a means for releasably latching the lever arm in each of a plurality of angular positions defined by holes in the lock plate.

5. A variable orifice as defined in claim 1 wherein the range of angular movement of the second plate relative to the first plate is at least approximately 90 degrees.

6. In combination:

a single channel flow conduit having a flow axis, a diameter across said axis and a solid outside wall and mounted to deliver a stream of particulate coal to a burner;

a variable valve mounted at least partially within the conduit for varying the effective cross-sectional area thereof between a minimum equal to about one-half of the total cross-sectional area of the conduit and a maximum approaching but not equaling the total cross-sectional area, said valve comprising a first plate having an upstream edge and a downstream edge fixably mounted within and extending across the diameter of the conduit and lying permanently in a plane parallel to the flow direction of said stream; and said variable valve further comprising a second plate having an upstream edge and a downstream edge angularly movably mounted within and across the diameter of the conduit such that the downstream edge of the second plate is immediately adjacent the downstream edge of the first plate adjacent the first plate such that the first and second plates form an acute and included angle therebetween into which the stream is directed; and means for selectively varying the angular relationship between the first and second plates; said conduit having an entry opening in said wall for inserting said first and second plates into the interior of the conduit.

7. The combination defined in claim 6 wherein said means for selectively varying comprises a shaft extending diametrically across the conduit and rotatably attached to the outside wall thereof at at least one place, said shaft being attached to an edge of the second plate and rotatable so as vary the angle between the second plate and the first plate.

8. The combination defined in claim 7 further comprising an indicator external to the conduit and attached to the shaft so as to rotate therewith.

9. The combination defined in claim 8 further comprising a lock plate and lock means releasably interconnecting the indicator in the lock plate so as to releasably fix the lock plate in any of a plurality of angular positions represented by holes formed in the lock plate.

10. The combination defined in claim 6 wherein the range of angular movement of the second plate relative to the first plate is at least about 90 degrees.

* * * * *

UNITED STATES PATENT AND TRADEMARK OFFICE

CERTIFICATE OF CORRECTION

PATENT NO. : 8,544,499 B2
APPLICATION NO. : 11/704664
DATED : October 1, 2013
INVENTOR(S) : Wark It is certified that error appears in the above-identified patent and that said Letters Patent is hereby corrected as shown below:

On the Title page, Item [75] delete "Wark E. Rickey" and insert --Rickey E. Wark--.

Signed and Sealed this
Twelfth Day of November, 2013

Teresa Stanek Rea

Teresa Stanek Rea
*Deputy Director of the United States Patent and Trademark Office*